US007883285B2

(12) United States Patent
Asada et al.

(10) Patent No.: US 7,883,285 B2
(45) Date of Patent: Feb. 8, 2011

(54) IMAGE RECORDING APPARATUS

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 965 days.

(21) Appl. No.: 11/679,623

(22) Filed: Feb. 27, 2007

(65) Prior Publication Data

US 2007/0201921 A1 Aug. 30, 2007

(30) Foreign Application Priority Data

Feb. 27, 2006 (JP) ..... 2006-049967

(51) Int. Cl.
*B41J 11/58* (2006.01)
*B41J 13/10* (2006.01)

(52) U.S. Cl. ..... 400/624; 271/9.08; 271/127

(58) Field of Classification Search ..... 400/624; 271/9.08, 127

See application file for complete search history.

(56) References Cited

U.S. PATENT DOCUMENTS 3,689,062 A * 9/1972 Suzuki ..... 271/117
2002/0060392 A1* 5/2002 Underwood et al. ..... 271/109
2005/0195242 A1 9/2005 Samoto et al. ..... 347/37
2005/0242485 A1 11/2005 Shiohara et al. ..... 271/109

FOREIGN PATENT DOCUMENTS

JP 61-188337 * 8/1986
JP 61-277525 * 12/1986
JP 06-87344 * 12/1994
JP 2005246907 9/2005
JP 2005314067 11/2005

OTHER PUBLICATIONS

U.S. Patent and Trademark Office, Office Action in co-pending U.S. Appl. No. 11/678,136, Notification Date Aug. 20, 2009 (raising provisional obviousness-type double patenting rejection based on the above-captioned patent application).

* cited by examiner

*Primary Examiner*—Ren Yan
*Assistant Examiner*—Marissa L Ferguson-Samreth
(74) *Attorney, Agent, or Firm*—Baker Botts L.L.P.

(57) ABSTRACT

An image recording apparatus includes a sheet-supply tray device, a sheet-supply roller and an image recording device. The sheet-supply tray device includes a first tray which accommodates a plurality of first recording media on a first tray surface and a second tray which is placed on the first tray and accommodates a plurality of second recording media on a second tray surface thereof. The second tray includes a base portion which is supported on the first tray and a pivotable portion whose state is changeable between a stacked state in which the pivotable portion is supported on the first tray.

13 Claims, 13 Drawing Sheets

IMAGE RECORDING APPARATUS

The present application is based on Japanese Patent Application No. 2006-049967 filed on Feb. 27, 2006, the contents of which are incorporated herein by reference.

BACKGROUND OF THE INVENTION

1. Field of the Invention

The present invention relates to an image recording apparatus which includes a sheet-supply tray device which accommodates a plurality of recording media, a sheet-supply roller which supplies the recording media one by one in a sheet-supply direction, and an image recording device which records an image on each of the supplied recording media.

2. Discussion of Related Art

There has been known an image recording apparatus which employs an image recording device which records an image on a recording sheet as a recording medium supplied from a sheet-supply tray device. The image recording apparatus is realized as an ink-jet printer or a laser printer, or otherwise as a multi-function device (MFD) which has a scanner function and/or a facsimile-machine function as well as a printer function.

The image recording apparatus also includes a sheet-supply tray device which accommodates a plurality of recording sheets as recording media. There is known a sheet-supply tray device of a type which holds recording sheets in a state in which the recording sheets are inclined with respect to a vertical direction; and there is another sheet-supply tray device which holds recording sheets in a state in which the recording sheets are supported horizontally In general, an image recording apparatus in which the recording sheets are conveyed through a straight path tends to adopt a sheet-supply tray device in which recording sheets are supported in an inclined state, while an image recording apparatus in which recording sheets are conveyed through a U-turn path tends to adopt a sheet-supply tray device in which the recording sheets are supported horizontally (for example, as disclosed in JP-A-2005-246907 or JP-A-2005-314067).

Each of the recording sheets accommodated in the sheet-supply tray device is supplied in a predetermined sheet-supply direction by a sheet-supply roller. For example, the sheet-supply roller is arranged to be movable toward, and away from, a tray surface of the sheet-supply tray device via a sheet-supply arm. The sheet-supply arm is pivotable in directions in which the arm moves toward and away from the sheet-supply tray device, and supports the sheet-supply roller rotatably about a rotation s extending in a direction perpendicular to the sheet-supply direction. A drive force from a drive source such as a motor is transmitted to rotate the sheet-supply roller. The sheet-supply arm is biased in a direction in which the sheet-supply roller is pressed on the tray surface of the sheet-supply tray device, by a biasing means such as a weight of the sheet-supply roller or a spring. Since the sheet-supply roller is pressed on the recording sheets accommodated in the sheet-supply tray device, the rotary movement of the sheet-supply roller is reliably transmitted to the recording sheets.

Also, a frictional pad is provided on the tray surface of the sheet-supply tray device, more specifically described, on a portion of the tray surface with which the sheet-supply roller is to come into contact. The frictional pad is made of a material having a frictional coefficient higher than that of the other portion of the tray surface. In this arrangement, a lowermost one of the recording sheets stacked in the sheet-supply tray device is difficult to slide relative to the tray surface. Therefore, in a state in which only a small amount of the recording sheets are left in the sheet-supply tray device, those recording sheets are prevented from being conveyed without being separated from each other In recent years, a full-color recording has been a function of an image recording apparatus. Therefore, the image recording apparatus is utilized not only for a document printing but for an image printing such as a photograph. In the document printing, recording sheets having A4 size in accordance with Japanese Industrial Standard (JIS) or legal size are often used. In the photograph printing, recording sheets having a size corresponding to a "L-size" printing paper for photographs are often used. In some cases, an image is recorded on a postcard or an envelope each as a recording medium. In addition, in the document printing, ordinary sheets are often used, whereas in the photograph printing, glossy sheets that are coated with a glossy material are often used. Since the image recording apparatus is used for a wide range of purposes, the recording sheets are so selected as to have appropriate sizes and sorts corresponding to the purposes. Therefore, it is needed to change the sizes and/or sorts of the recording sheets to be accommodated in the sheet-supply tray device, depending upon the manner of printing corresponding to each of the purposes.

For example, in a case in which ordinary sheets of A4 size which are often used in the document printing are accommodated in the sheet-supply tray device, an auxiliary tray may be provided in the image recording apparatus so that the auxiliary tray accommodates L-size glossy sheets which are often used in the photograph printing. However, it is needed to provide a sheet-convey path between the auxiliary tray and the image printing device and employ a sheet-supply roller corresponding to the auxiliary tray. This leads to increasing the size of the image recording apparatus and the cost of manufacture thereof.

SUMMARY OF THE INVENTION

In the light of the above-described technical background, the present invention has been developed. It is therefore an object of the present invention to provide an image recording apparatus which includes a sheet-supply tray device that can accommodate a plurality of recording media with different sizes and/or sorts, and which achieves at least one of the following objects: (a) that the sheet-supply tray device has a simple structure and a small size; (b) that recording media can be easily set in the sheet-supply tray device; and (c) that recording media can be supplied with stability.

According to the present invention, there is provided an image recording apparatus comprising a sheet-supply tray device which accommodates a plurality of recording media; a sheet-supply roller which supplies the recording media one by one in a sheet-supply direction; and an image recording device which records an image on each of the supplied recording media. The sheet-supply tray device includes a first tray which accommodates a plurality of first recording media on a first tray surface thereof such that the first recording media are stacked on each other and a second tray which is placed on the first tray and which accommodates a plurality of second recording media on a second tray surface thereof such that the second recording media are stacked on each other. The second tray includes a base portion which is supported on the first tray and which constitutes a downstream tray surface that is a downstream side portion of the second tray surface in the sheet-supply direction; and a pivotable portion whose state is changeable between a stacked state in which the pivotable portion is supported on the first tray and an opening state in which the pivotable portion is pivoted relative to the base portion so as to open a space above the first tray and which constitutes an upstream tray surface that is an upstream side portion of the second tray surface in the sheet-supply direction. The pivotable portion includes a nip portion which constitutes a part of the upstream tray surface and which the sheet-supply roller advances toward and retracts from. In a state in which the pivotable portion is in the stacked state, at least one of (a) the nip portion and (b) a portion of the pivotable portion adjacent to the nip portion is supported by the base portion, The sheet-supply tray device includes the first tray and the second tray which is placed on the first tray, that is, the sheet-supply tray device has a stacked structure. The first tray and the second tray accommodate the first recording media and the second recording media, respectively. Therefore, the sheet-supply tray device can accommodate simultaneously the first and second recording media which may be of different sizes and/or different sorts.

The second tray includes the base portion and the pivotable portion. The base portion is supported on the first tray and constitutes a downstream tray surface that is a downstream side portion of the second tray surface in the sheet-supply direction. The pivotable portion in the stacked state is supported on the base portion and constitutes an upstream tray surface that is an upstream side portion of the second tray surface in the sheet-supply direction. The second tray surface of the second tray comprises the downstream tray Surface and the upstream tray surface. The pivotable portion is pivotable relative to the base portion. In the stacked state, the pivotable portion is supported on the base portion, and in the opening state, the pivotable portion is pivoted relative to the base portion so as to open a space above the first tray. By a user's operation, the pivotable portion is changeable between the stacked state and the opening state. In the opening state of the pivotable portion, the recording media can be easily set in the first tray.

The pivotable portion includes the nip portion which the sheet-supply roller advances toward and retracts from. On the nip portion, there may be provided a member which is made of a material having a frictional coefficient higher than that of the other portion of the second tray surface, such as a cork or a rubber, for preventing the recording media from being conveyed without being separated from each other. The nip portion constitutes a part of the upstream tray surface, so that the nip portion is pivoted along with the pivotable portion. In the state in which the pivotable portion is in the stacked state, at least one of (a) the nip portion and (b) the portion of the pivotable portion adjacent to the nip portion is supported by the base portion. The second recording media accommodated in the second tray are placed on the pivotable portion supported by the base portion. When the sheet-supply roller advances toward the nip portion, the recording media are nipped by the sheet-supply roller and the nip portion. In the state in which the recording media are nipped as mentioned above, when the sheet-supply roller is rotated, each of the recording media is supplied in the sheet-supply direction. The sheet-supply roller is pressed on the recording media so as to supply each of the recording media with reliability. The pressure of the sheet-supply roller is transmitted to the nip portion via the recording media. Since at least one of (a) the nip portion and (b) the portion of the pivotable portion adjacent to the nip portion is supported by the base portion, the nip portion and the adjacent portion of the pivotable portion are prevented from being bent by the pressure.

In the image recording apparatus in accordance with the present invention, since the sheet-supply tray device includes the first tray and the second tray, the sheet-supply tray device accommodates the first and second recording media which may be of different sizes and/or different sorts. Therefore, the sheet-supply tray device can simultaneously accommodate two kinds of recording media which are often used.

By the user's operation, the pivotable portion of the second tray can be pivoted relative to the base portion so that a space above the first tray is opened. In the opening state of the pivotable portion, the recording media can be easily set in the first tray.

The pivotable portion includes the nip portion which the sheet-supply roller advances toward and retracts from. Since at least one of (a) the nip portion and (b) the portion of the pivotable portion adjacent to the nip portion is supported by the base portion, the nip portion can resist the pressing force of the sheet-supply roller. In this arrangement, the pivotable portion is prevented from being flexed by the pressure of the sheet-supply roller during the supplying of the recording media, so that the recording media can be supplied with a high stability.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
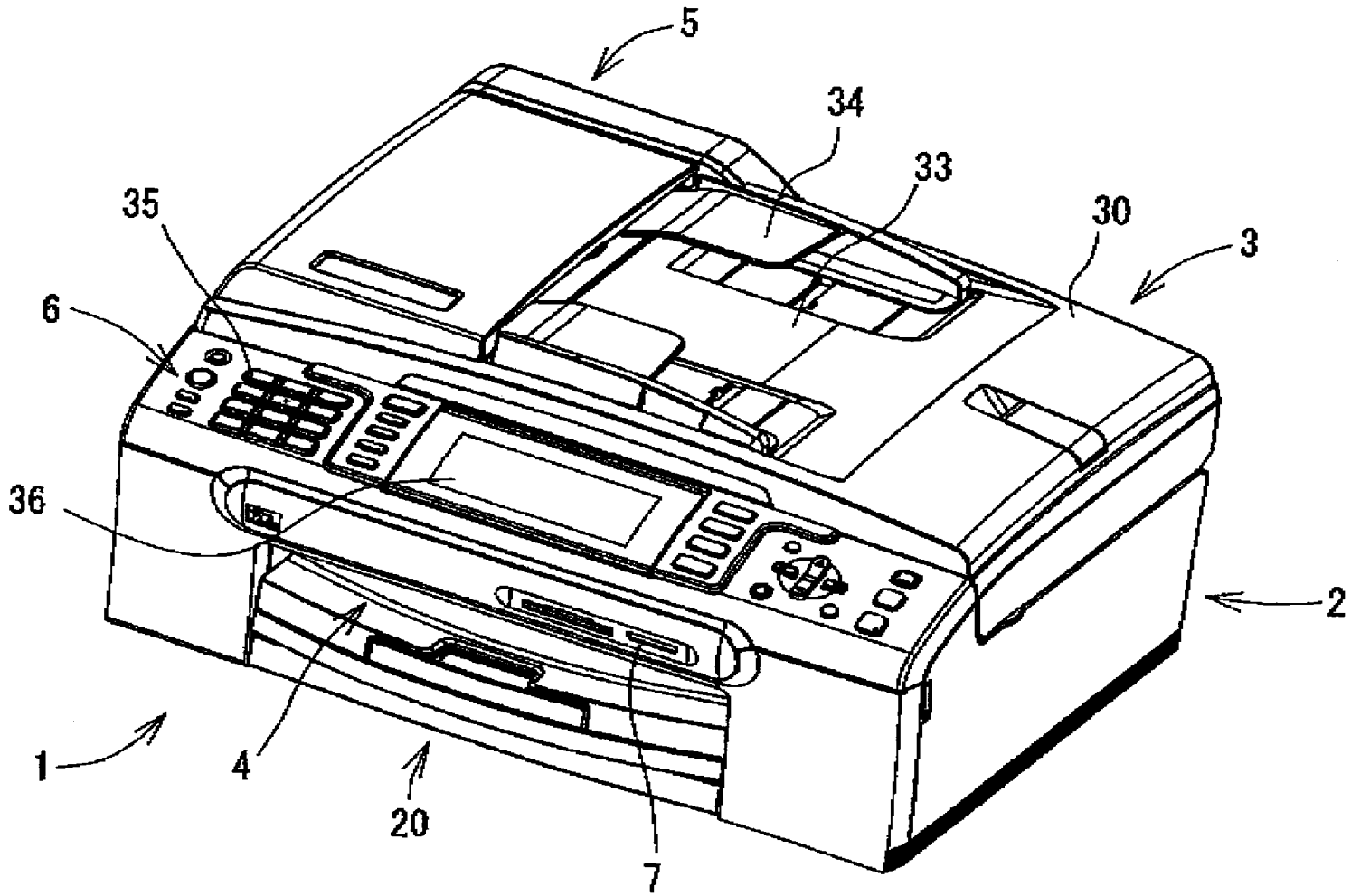
FIG. 1 is a perspective view of a multi-function device (MED) including an image recording apparatus to which the present invention is applied.
Figure 2:
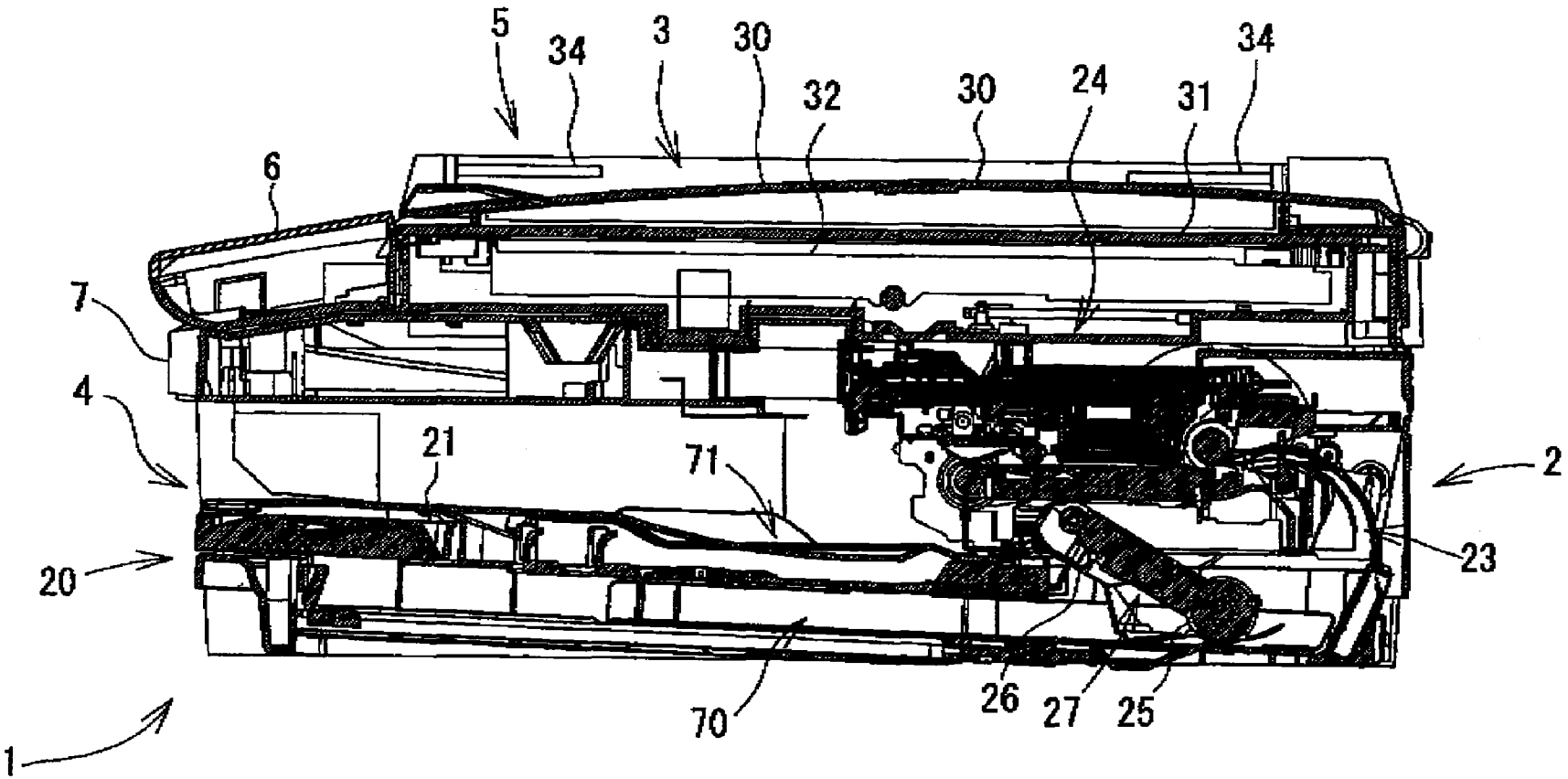
FIG. 2 is a side elevational view in cross section showing an internal structure of the MFD.

Hereinafter, there will be described preferred embodiments of the present invention by reference to the drawings. FIG. 1 shows a perspective view of a multi-function device (MFD) 1 including an image recording apparatus as an embodiment of the present invention. FIG. 2 shows a side elevational view in cross section showing an internal structure of the MFD) 1. The MFD 1 includes a printer portion 2 provided in a lower portion thereof, and a scanner portion 3 provided in an upper portion thereof that is integral with the lower portion, and has a printer function, a scanner function, a copier function and a facsimile-machine function. In the present embodiment, the printer portion 2 corresponds to the image recording apparatus to which the present invention is applied. The functions other than the printer function may be omitted, that is, the scanner portion 3 may be omitted. Thus, the present invention may be applied to a single-function printer that has only the printer function and does not have the scanner, copier or facsimile-machine function.

The MFD 1 may be connected to an external computer, not shown, so that the printer portion 2 can record, based on image data or document data supplied from the computer, an image or a document on a recording sheets as recording medium. Also, the MFD 1 may be connected to an external device such as a digital camera, so that the printer portion 2 can record, based on image data outputted from the digital camera, an image on a recording sheet. Moreover, the MED 1 includes a memory receiving portion that can receive each of various sorts of memories, such as a memory card, so that the printer portion can record, based on image data stored in the each memory, an image on a recording sheet.

When the MFD 1 functions as the scanner, an original image of an original sheet (a reading medium) is read by the scanner portion 3 and image data representing the read original image are transmitted to the external computer. The image data may be stored in each of various sorts of memories such as the memory card. When the MFD 1 functions as the copier, the printer portion 2 records an image on a recording sheet based on the image data read by the scanner portion 3. When the MFD 1 functions as the facsimile-machine, the image data read by the scanner portion 3 are transmitted as facsimile data through a telephone line. The printer portion 2 may record, based on received facsimile data, an image on a recording sheet.

As shown in FIG. 1, a width and a length of the MFD 1 are greater than a height thereof. Thus, the MFD 1 has a generally rectangular parallelepiped shape. The printer portion 2 is provided in the lower portion of the MFD 1. The printer portion 2 includes a front opening 4 formed in a front surface of the MFD 1, and a sheet-supply tray device 20 that is exposed through the front opening 4. A structure of the sheet-supply tray device 20 is described later.

The scanner portion 3, i.e., so-called "flat-bed" scanner is provided in the upper portion of the MFD 1. As shown in FIGS. 1 and 2, the scanner portion 3 includes a cover member 30 as a top plate that can cover the original sheet placed on an upper surface of a platen glass 31. The cover member 30 is pivotable upward and downward so as to be opened and closed. An image sensor 32 is provided below the platen glass 31. The original sheet has an original image to be read by the scanner portion 3. A main scanning direction in which the image sensor 32 is moved to read the original image from the original sheet is a lengthwise direction of the MFD 1. That is, the image sensor 32 is reciprocateable in a direction perpendicular to the drawing sheet of FIG. 2.

The cover member 30 is equipped with an ADF (automatic document feeder) 5 for continuously conveying original sheets from an original-sheet tray 33 to a sheet-discharge tray 84 via a sheet-convey path, not shown. During the conveying of the original sheets by the ADF 5, each of the original sheets is temporarily stopped on the platen glass 31 and an original image on the each original sheet is read by the image sensor 32 which is located below the platen glass 31. In the present embodiment, since the scanner portion 3 and the ADF 5 are not directly related to the present invention, detailed descriptions thereof are omitted.

An operation panel 6 is provided in a front end portion of a top portion of the MFD 1. The operation panel 6 is for operating the printer portion 2 and the scanner portion 3. The operation panel 6 includes various operation keys 35 and a liquid crystal display (LCD) 36 that are used by a user to input various commands to operate the MFD 1. In the case where the MFD 1 is connected to the above-described external computer, the MFD 1 can be operated according to commands supplied from the computer via a printer driver or a scanner driver The MFD 1 has, in a top portion of the front surface thereof (FIG. 1), a slot portion 7 in which each of various sorts of small-size memory cards each as a data memory can be inserted. Through user's operation of the operation panel 6, the MFD 1 can read image data stored by the each memory card inserted in the slot portion 7 so that based on the thus read image data, images may be displayed by the LCD 36 of the operation panel 6. The user can select, by operating the keys 35 of the operation panel 6, one or more desired images from the images displayed on the LCD 35, so that the printer portion 2 may record the images on the recording sheets, respectively.

Hereinafter, there will be described an internal construction of the MFD 1, especially a construction of the printer portion 2, by reference to the drawings. As shown in FIG. 2, there is provided a sheet-feed path 23 above the sheet-supply tray device 20. The sheet-feed path 23 first extends upward from a rear portion of the MFD 1 along a rear surface of the MFD 1, then curves toward the front side (i.e., left-hand side in the figure) of the MFD 1, and further extends to the front opening 13. That is, the sheet-feed path 23 extends from the rear side of the MFD 1 toward the front side thereof via an image recording unit 24 as an image recording device and the sheet-discharge tray 21 above the sheet-supply tray device 20. Thus, the sheet-feed path 23 includes a U-tun portion through which the direction of feeding of each recording sheet is changed from the rearward direction to the frontward direction before the each recording sheet is fed to the image recording unit 24. After the image recording unit 24 records an image on the each recording sheet, the each sheet is discharged onto the sheet-discharge tray 21.

Figure 3:
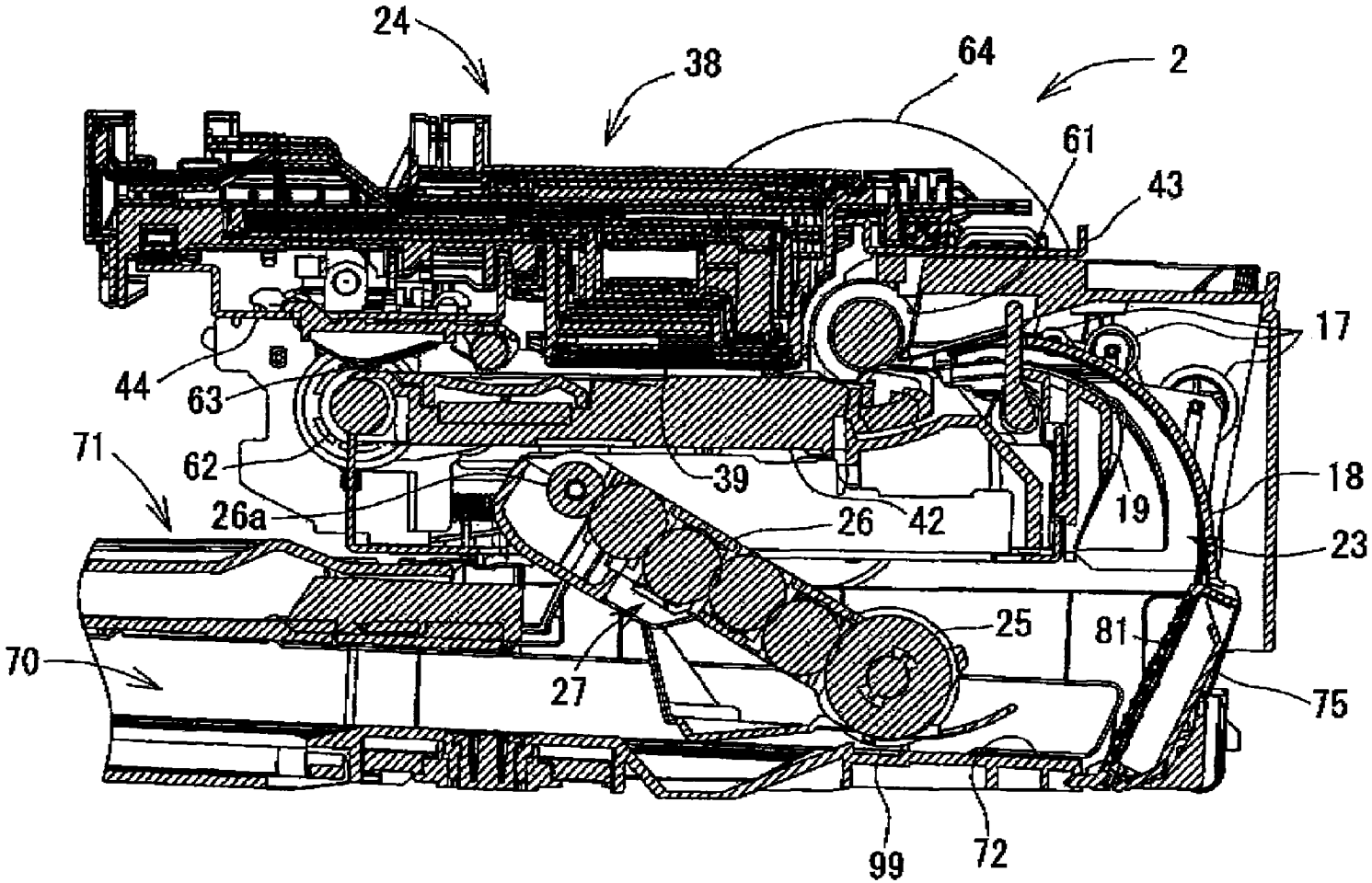
FIG. 3 is an enlarged, cross-sectional view of a printer portion of the MFD.

FIG. 3 shows an enlarged, cross-sectional view of the printer portion 2 of the MFD 1. As shown in FIG. 3, a sheet-supply roller 25 is provided above the sheet-supply tray device 20. The sheet-supply roller 25 is pressed on the recording sheets stacked in the sheet-supply tray device 20 and supplies each recording sheet to the sheet-feed path 23. The sheet-supply roller 25 is rotatably supported by a lower or distal end portion of a sheet-supply arm 26. The sheet-supply roller 25 is rotated about a rotation axis perpendicular to a sheet-feed direction. The sheet-feed direction is a direction in which each recording sheet is fed. The sheet-supply roller 25 has, as an outer circumferential surface thereof, a roller surface that is made of a synthetic rubber. The roller surface has straight knurling to increase a frictional coefficient thereof with respect to the recording sheets.

The sheet-supply arm 26 is supported by a frame (not shown) of a main body of the MFD 1 and is pivotable upward and downward about a base shaft **26*a* as a rotation axis so as to be movable away from and toward the sheet-supply tray device 20. As shown in FIG. 3, the sheet-supply arm 26 is pivoted downward because of a weight thereof so as to contact the sheet-supply tray device 20. When the sheet-supply tray device 20 is inserted into, or removed from, the front opening 4 of the main body of the MFD 1, the sheet-supply arm 26** is pivoted upward so as to take a substantially horizontal posture.

Not shown in FIG. 3, a gear which is driven or rotated by a motor is fixed to the base shaft 26*a* such that a rotation axis of the gear is concentric with the rotation axis of the base shaft 26*a*. Another gear is fixed to the sheet-supply roller 25 such that a rotation axis of the gear is concentric with the rotation axis of the sheet-supply roller 25. Between the two gears, there is provided a power transmission device that includes a plurality of gears meshed with each other. Thus, the sheet-supply roller 25 is driven or rotated by the motor. The sheet-supply arm 26 is freely pivotable about the base shaft 26*a* so that the arm 26 is biased downward because of the weight thereof.

Figure 4:
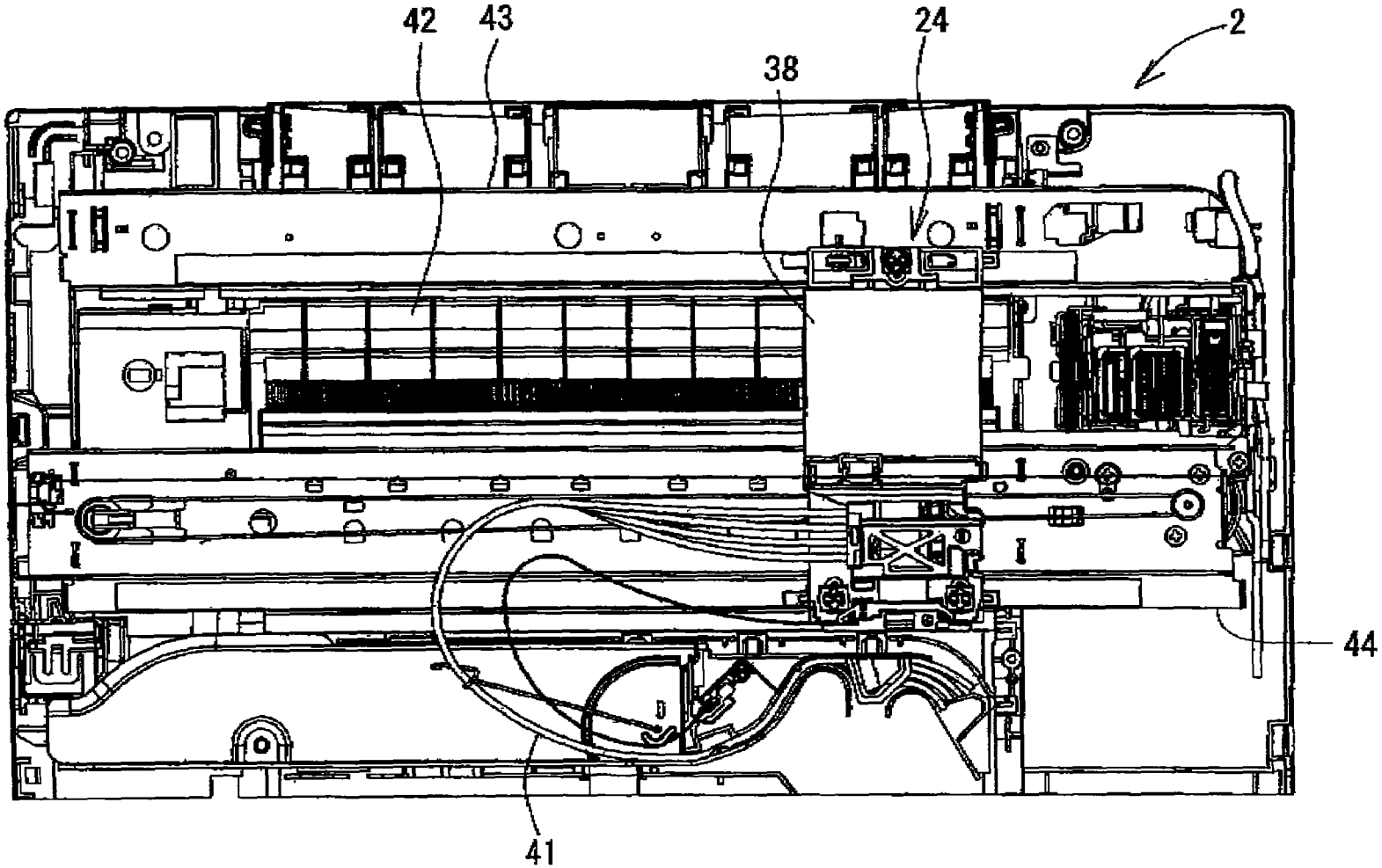
FIG. 4 is a plan view showing a basic structure of the printer portion of the MFD.

Except for a portion of the sheet-feed path 23 where the image recording unit 24 is provided, the sheet-feed path 23 is defined and constituted by an outer guide surface and an inner guide surface that are opposed to each other with an appropriate distance therebetween. For example, in the rear side of the MFD 1, the sheet-feed path 23 is constituted by an outer guide member 18 and an inner guide member 19 which are fixed to each other inside the frame. One or more guide rollers 17 are provided on the outer guide member 18. Owing to the guide rollers 17, each recording sheet can be conveyed smoothly while being continuously contacted with the outer guide surface of the sheet-feed path 23, even at the U-turn portion thereof As shown in FIG. 3, the image recording unit 24 is provided in the sheet-feed path 23. As shown in FIGS. 3 and 4, the image recording unit 24 includes a recording head 39 and carriage 38 that carries the recording head 39 and that can be moved or reciprocated in the main scanning direction. Ink cartridges are provided in the MFD 1, away from the carriage 38. A cyan ink (C), a magenta ink (M), a yellow ink (Y), and a black ink (K) which are stored in the respective ink cartridges are supplied to the recording head 39 via respective ink-supply tubes 41. While the carriage 38 is reciprocated along a predetermined movement path, in the main scanning direction, the recording head 39 ejects droplets of the inks toward each recording sheet being temporarily stopped on the platen 42. Thus, a desired image is recorded on the recording sheet.

FIG. 4 is a plan view showing a pertinent structure of the printer portion 2. As shown in FIG. 4, a pair of guide rails 43, 44, provided above the sheet-feed path 23, are distant from each other by an appropriate distance in the sheet-feed direction (i.e., a leftward direction as seen in FIG. 3), and extend parallel with each other in a direction perpendicular to the sheet-feed direction (in leftward and rightward directions in FIG. 4). The carriage 38 bridges the two guide rails 43, 44 in the sheet-feed direction such that the carriage 38 is slidable in the horizontal directions perpendicular to the sheet-feed direction.

As shown in FIG. 3, a convey roller (a register roller) 61 is provided on an upstream side of the image recording unit 24. The convey roller 61 is rotated about a rotation axis perpendicular to the sheet-feed direction by being driven or rotated by a motor. The convey roller 61 cooperates with a pinch roller, not shown, to pinch and feed the recording sheet onto the platen 42.

On a downstream side of the image recording unit 24, there is provided a discharge roller 62. The discharge roller 62 is rotated about a rotation axis perpendicular to the sheet-feed direction by being driven or rotated by the motor. The discharge roller 62 cooperates with a spur roller 63 to feed the recorded sheet to the sheet-discharge tray 21. In order to prevent the deterioration of the image recorded on the recording sheet, the spur roller 63 has a plurality of projections along an outer circumferential surface thereof.

Figure 11:
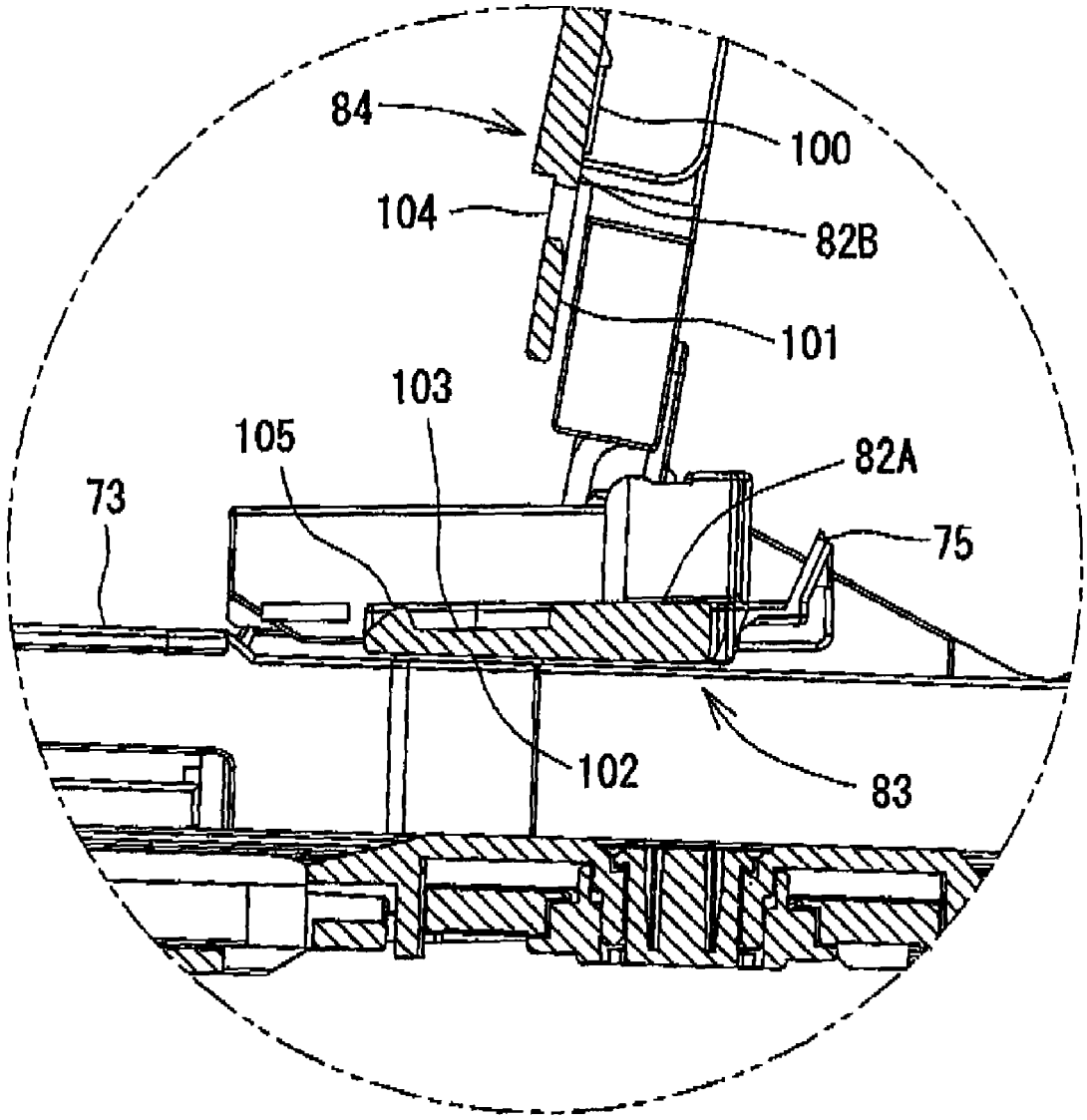
FIG. 11 is an enlarged, cross-sectional view showing a structure around a nip portion of the second tray in the opening state.
Figure 12:
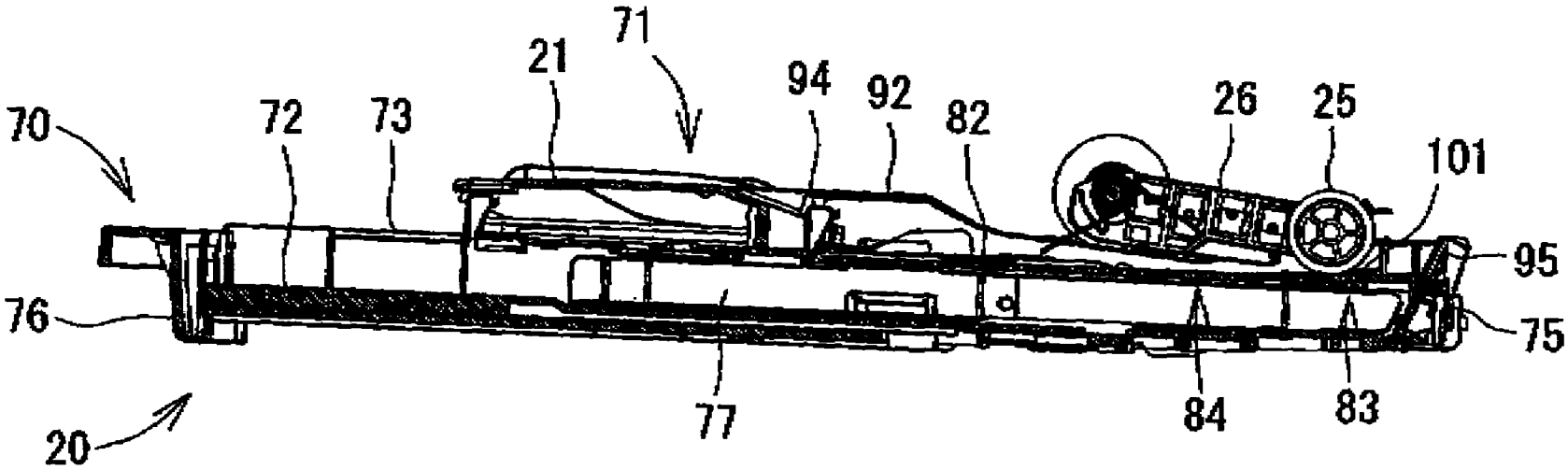
FIG. 12 is a cross-sectional view taken along line 12-12 in FIG. 8.
Figure 13:
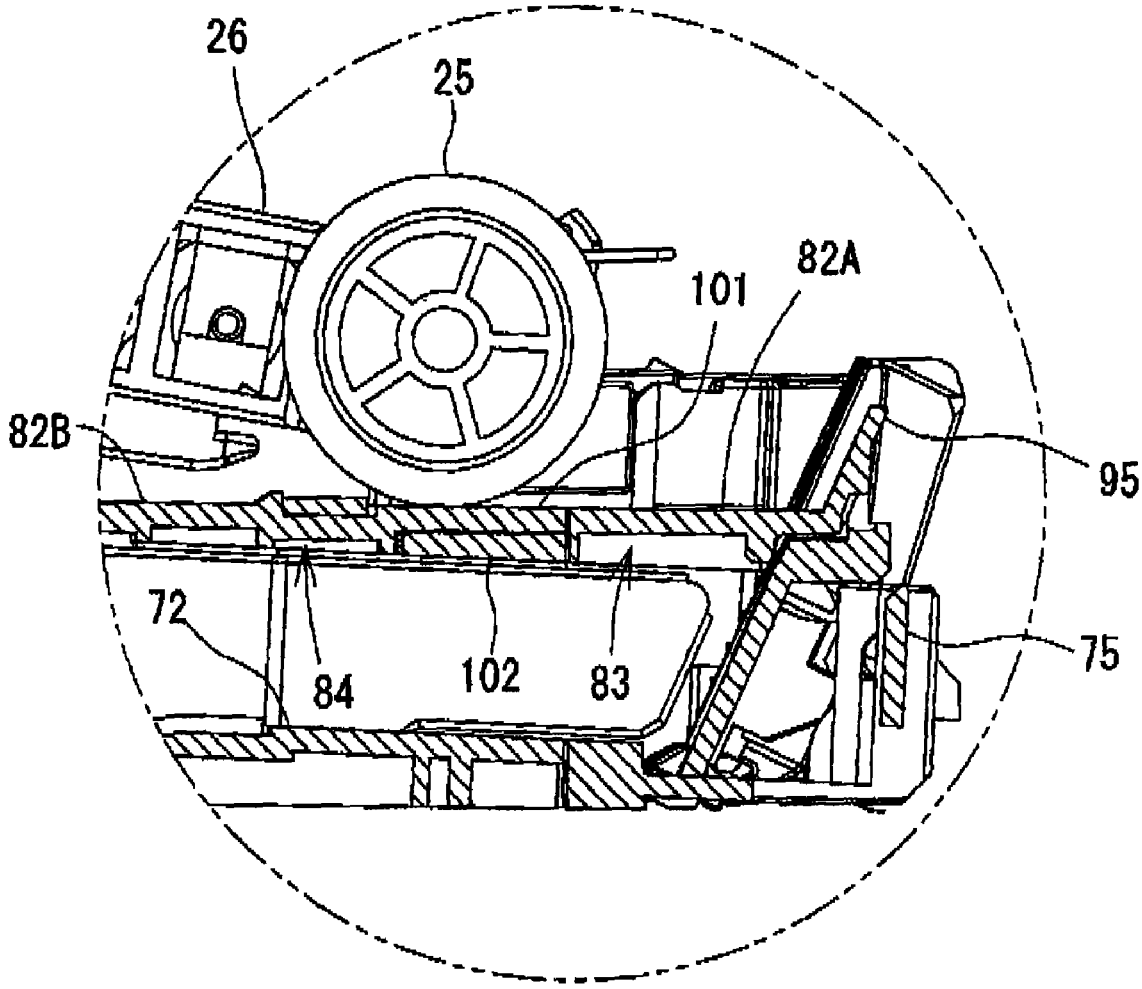
FIG. 13 is an enlarged, cross-sectional view showing the structure around the nip portion shown in FIG. 12.

The convey roller 61 and the discharge roller 62 are intermittently rotated by the motor so as to feed the recording sheet by each incremental amount corresponding to each line of image. The convey roller 61 and the discharge roller 62 are rotated in synchronism with each other. A rotary encoder provided in association with the convey roller 61 includes an optical sensor that detects slits or patterns of an encoder disc 64 which rotates with the convey roller 61 and produces pulse signals corresponding to the detected slits. The respective rotations of the convey roller 61 and the discharge roller 62 are controlled based on the pulse signals Next, there will be described in detail the construction of the sheet-supply tray device 20 by reference to FIGS. 5 through 13. For the convenience of explanation, the sheet-supply roller 25 and the sheet-supply arm 26 are shown in FIGS. 6, 12 and 13. However, the sheet-supply roller 25 and the sheet-supply arm 26 are not parts of the sheet-supply tray device 20. In the following description, the sheet-feed direction in which the recording sheets are fed by the sheet-supply roller 25 in the sheet-supply tray device 20 is especially referred to as a sheet-supply direction.

Figure 5:
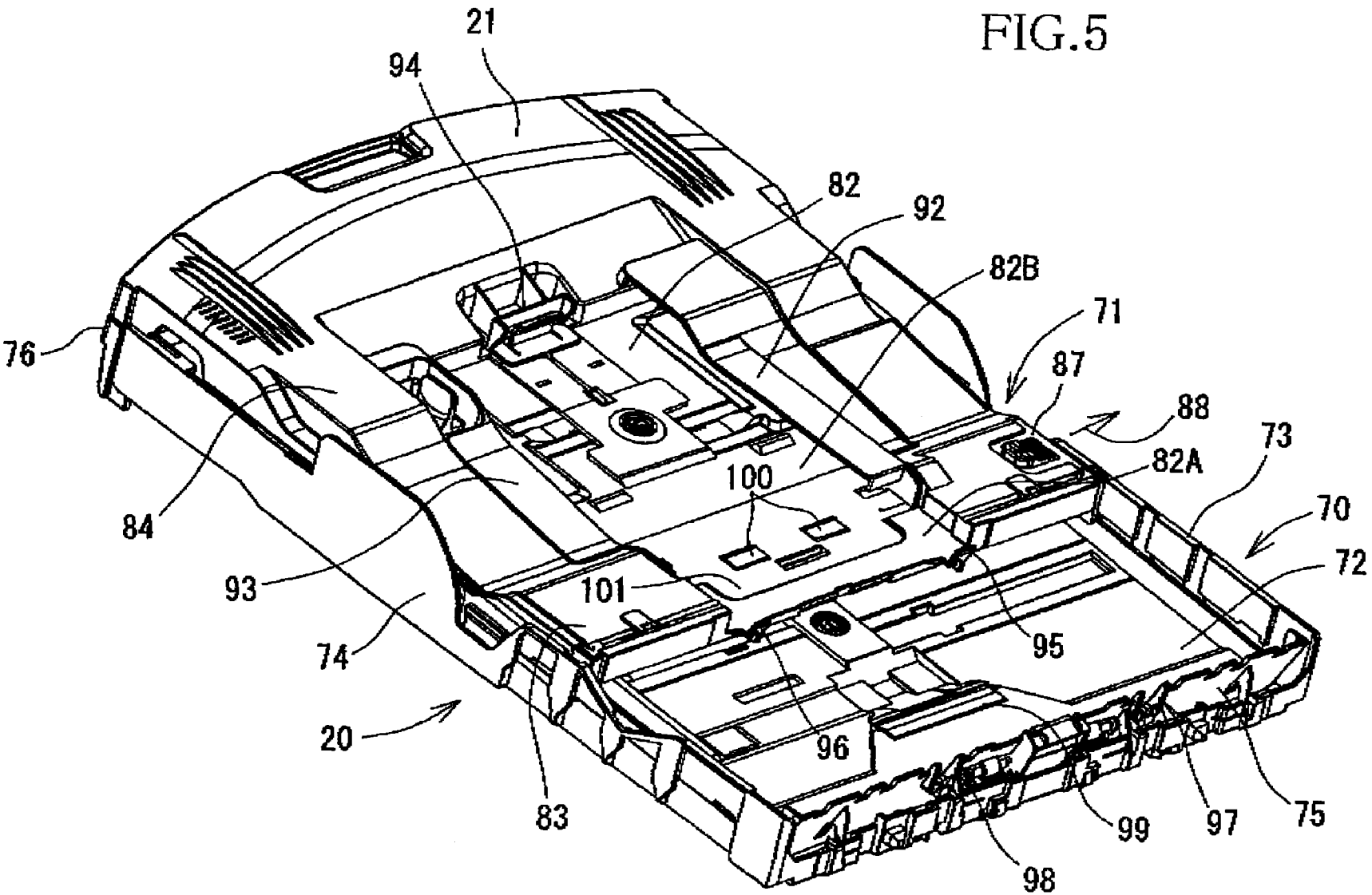
FIG. 5 is a perspective view of a sheet-supply tray device whose second tray is in a stacked state.
Figure 6:
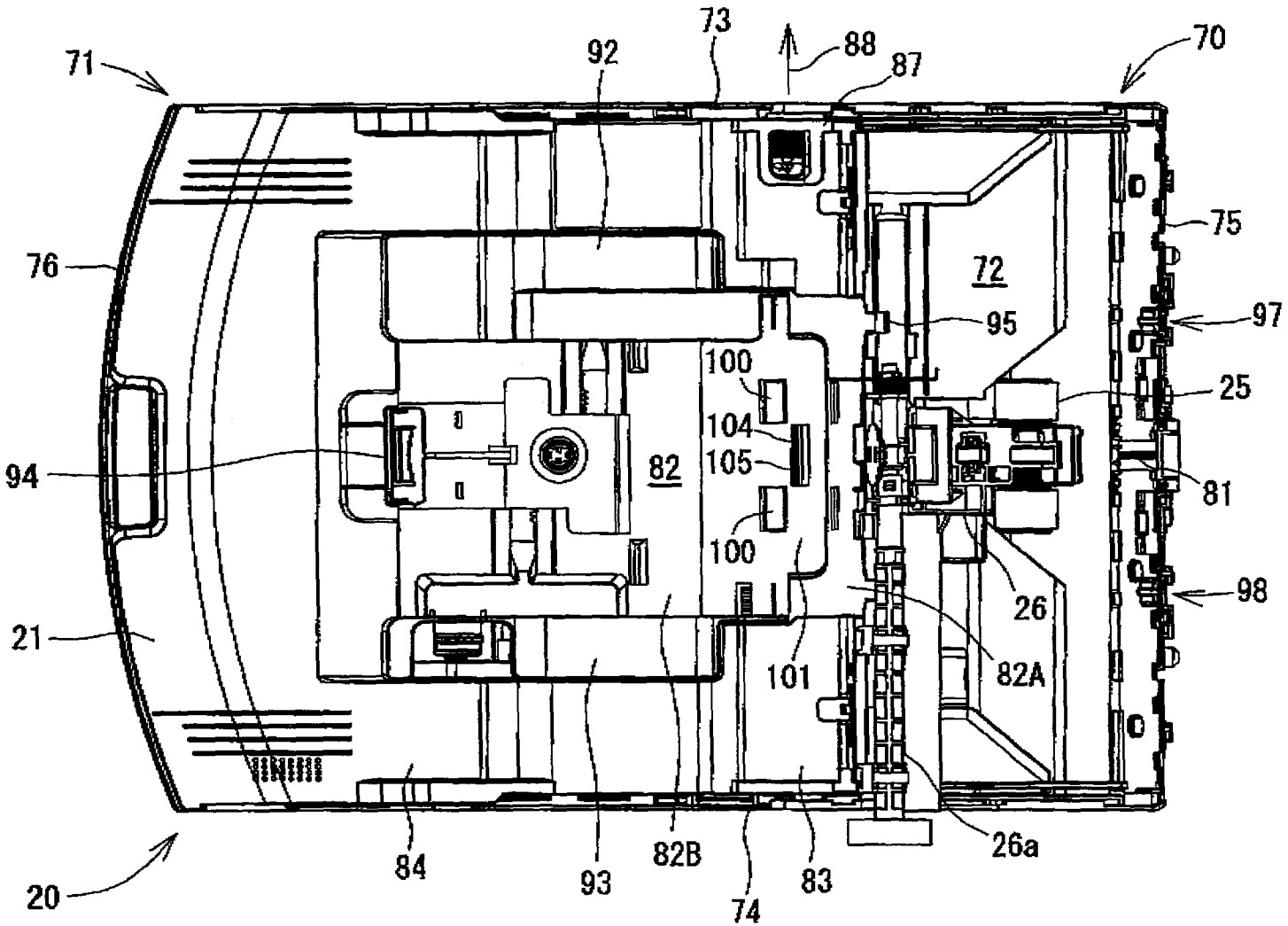
FIG. 6 is a plan view of the sheet-supply tray device whose first tray is in use.

As shown in FIG. 5, the sheet-supply tray device 20 includes a first tray 70 and a second tray 71. As shown in FIG. 1, the sheet-supply tray device 20 is inserted into the front opening 4 so as to be attached to the MFD 1. The sheet-supply tray device 20 is drawn from the opening 4 so as to be detached from the MFD 1. As shown in FIG. 5, the second tray 71 is placed on the first tray 70, that is, the first and the second trays 70, 71 have a vertically stacked structure. The first tray 70 has a dish-like shape which includes a plurality of (four in the present embodiment) side walls 73, 74, 75, 76 standing upright from a periphery of a bottom plate having a first tray surface 72. The first tray surface 72, in its plan view, has a rectangular shape. For example, the first tray 70 is produced by molding of a synthetic resin. The first tray surface 72 has an area that is slightly larger than that of A4 size defined by JIS. Thus, the first tray 70 can accommodate the plurality of recording sheets as the first recording media that are of a size, not larger than A4 size, such that the recording sheets are stacked on each other.

Figure 9:
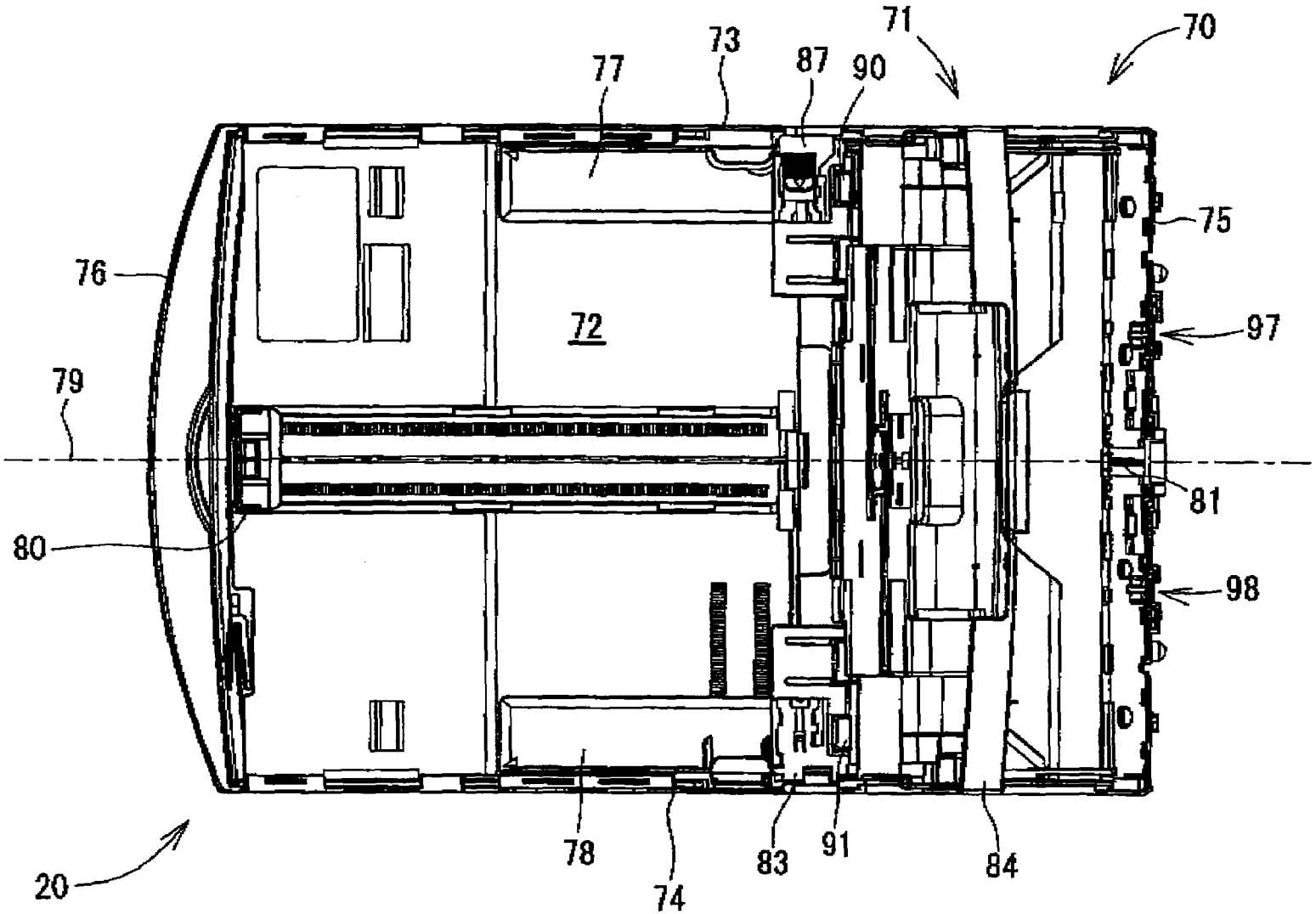
FIG. 9 is a plan view of the sheet-supply tray device whose second tray is in an opening state.

As shown in FIG. 9, the first tray 70 includes a pair of side guide members 77, 78 which extend parallel with the side walls 73, 74, respectively, and are movable toward and away from the side walls 73, 74, respectively. The recording sheets are placed between the side guide members 77, 78, so that respective side edges of the recording sheets are positioned in the first tray 70. The two side guide members 77, 78 are moved corresponding to the size of the recording sheets accommodated in the first tray 70 so that a distance between the side guide members 77, 78 is changed. That is, the two side guide members 77, 78 are slidable from a state shown in FIG. 9 toward a centerline of the first tray surface 72 so as to shorten the distance therebetween. Not shown in FIG. 9, the pair of side guide members 77, 78 are interlocked with each other by a rack and pinion device and are slid symmetrically with respect to a centerline (a reference line 79) of the first tray surface 72 that is parallel to the sheet-supply direction. Therefore, when the recording sheets are positioned by and between the two side guide members 77, 78, a centerline of each recording sheet parallel to the sheet-supply direction is aligned with the reference line 79. The positioning of the recording sheets in this manner is referred to as the "center-registering".

Also, the first tray 70 includes a rear end guide member 80 which is movable toward and away from the side wall 76. The rear end guide member 80 is moved so as to change a distance between the rear end guide member 80 and the side wall 75 corresponding to the size of the recording sheets accommodated in the first tray 70. The recording sheets are placed between the rear end guide member 80 and the side wall 75 and positioned in a state in which leading ends of the recording sheets contact the side wall 75. Not shown in FIG. 9, the rear end guide member 80 is slidable together with the side wall 76 in a direction away from the side wall 75. The side wall 76 is formed integrally with an extension tray which is accommodated below the bottom plate having the first tray surface 72. When the side wall 76 and the rear end guide member 80 are slid in the direction away from the side wall 75, the extension tray comes out so that the first tray surface 72 is extended. Thus, the first tray 70 can accommodate recording sheets of a size, such as legal size, larger than A4 size.

As shown in FIGS. 5 and 9, the side wall 75 is inclined such that an upper end portion thereof extends obliquely outward and rearward. As shown in FIG. 3, in a state in which the sheet-supply tray device 20 is inserted in the MFD 1, the side wall 75 is located right below the sheet-feed path 23 and is aligned with the guide surface of the outer guide member 18. Thus, the recording sheets are guided by the side wall 75 from the first tray surface 72 toward the guide surface of the outer guide member 18. As shown in FIGS. 3 and 9, the side wall 75 is equipped with a sheet-separate member 81 provided along the reference line 79. The sheet-separate member 81 has a plurality of teeth which protrude inwardly from the side wall 75 and which are arranged in the sheet-feed direction. The uppermost one of the recording sheets accommodated in the first tray 70 is separated from the other sheets such that the uppermost sheet projects toward the sheet-feed path 23 in the sheet-feed direction along an inclined surface of the side wall 75. Since the teeth of the sheet-separate member 81 engage the recording sheets, only the uppermost sheet is surely separated from the other sheets.

As shown in FIGS. 5 and 6, the second tray 71 is provided above the first tray 70, such that the second tray 71 is supported by the side walls 73, 74 of the first tray 70. The second tray 71 has a generally plate-like shape and, for example, is produced by molding of a synthetic resin. The second tray 71, in its plan view, has a width (a dimension measured in a direction perpendicular to the sheet-supply direction and parallel to the first tray surface 72) which is approximately equal to that of the first tray surface 72 of the first tray 70 and a length (a dimension measured in the sheet-supply direction) which is smaller than that of the first tray surface 72. That is, in the sheet-supply tray device 20 in its plan view, a major part of the first tray surface 72 is covered by the second tray 71. FIGS. 5 and 6 show a state in which a downstream portion (a right-hand portion in FIG. 6) of the first tray surface 72 in the sheet-supply direction is exposed. This is a state in which the first tray 70 is in use and the second tray 71 is at a retracted position (hereinafter, referred to as the "in-use state of the first tray 70").

The second tray 71 has a recessed portion provided in a middle thereof which constitutes a second tray surface 82 on which recording sheets as second recording media are stacked. A bank portion provided around the second tray surface 82 constitutes the sheet-discharge tray 21. Thus, the second tray 71 has two roles; one for accommodating and holding the recording sheets before images are recorded and the other role for supporting the recording sheets on which the images have been recorded. The second tray surface 82 is smaller than the first tray surface 72 and used for accommodating recording sheets of a relatively small size such as postcard size or L size. Thus, recording sheets of a size often used, such as A4 size or legal size, can be accommodated by the first tray 70, and recording sheets different in size or material from the sheets accommodated by the first tray 70 can be accommodated by the second tray 71.

The second tray 71 includes a base member 83 provided in a downstream portion thereof in the sheet-supply direction and a flap member 84 provided in an upstream portion thereof in the sheet-supply direction. The base member 83 corresponds to a base portion of the second tray 71 and the flap member 84 corresponds to a pivotable portion of the same 71. The second tray surface 82 is defined by the base member 83 and the flap member 84 and includes a downstream second tray surface 82A of the base member 83 and an upstream second tray surface 82B of the flap member 84. The downstream second tray surface 82A and the upstream second tray surface 82B constitute a second tray surface 82.

As shown in FIG. 6, the base member 83, in its plan view, has a plate-like shape and has a width (a dimension measured in the direction perpendicular to the sheet-supply direction and parallel to the first tray surface 72) which is approximately equal to that of the first tray surface 72 of the first tray 70 and a length (a dimension measured in the sheet-supply direction, i.e., the leftward and rightward directions as seen in FIG. 6) which is much smaller than the first tray surface 72. In other words, the base member 83 has an elongate plate-like shape which is elongate in a widthwise direction of the first tray surface 72. The base member 83 is supported on the side walls 73, 74 of the first tray 70 such that the base member 83 is slidable in the sheet-supply direction.

Figure 7:
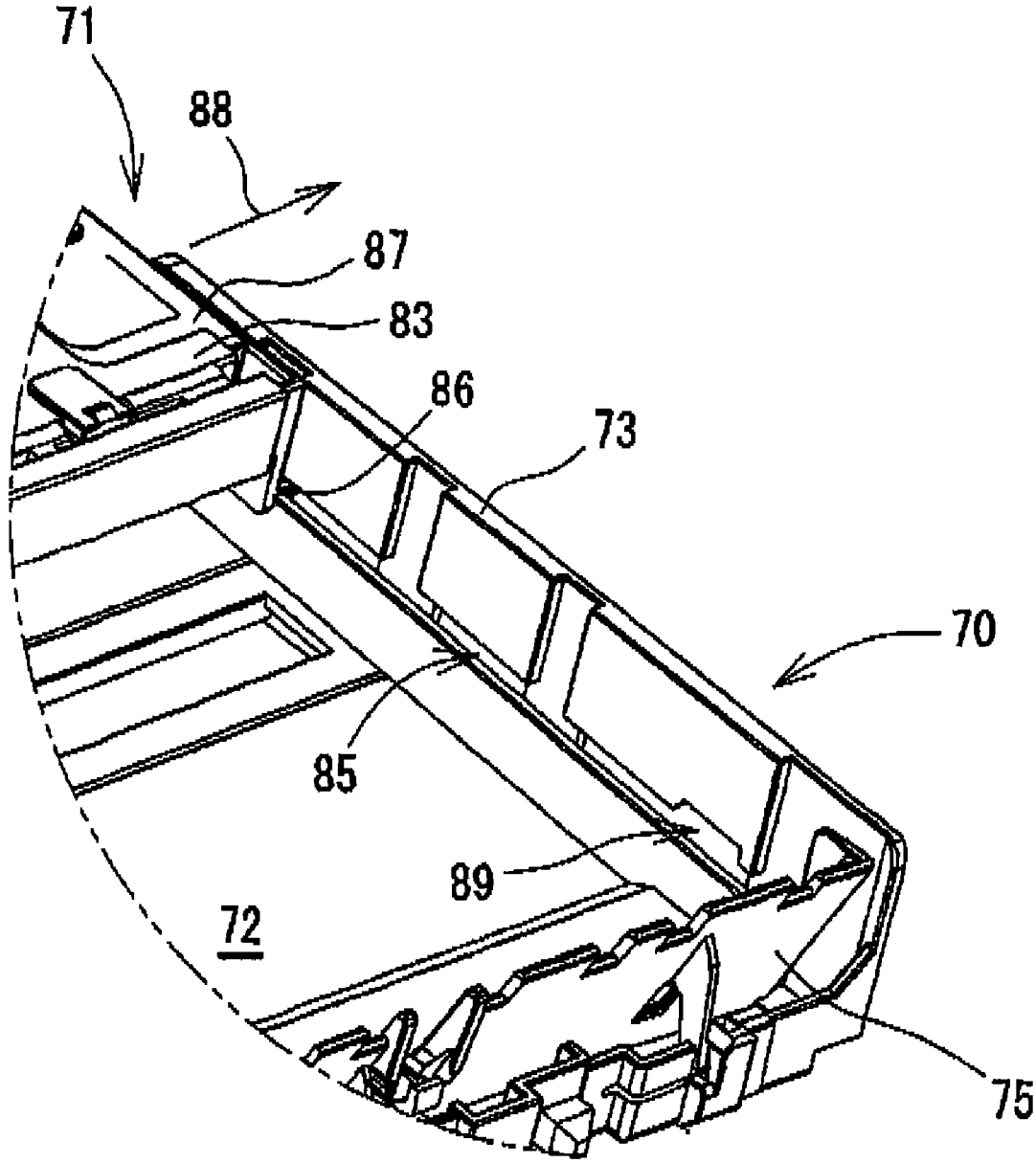
FIG. 7 is an enlarged, perspective view showing a structure around side walls of the sheet-supply tray device.

As shown in FIG. 7, the side wall 73 has a slit 85 extending horizontally at a predetermined height. The base member 83 has a slider 86 extending horizontally from one side end thereof. The slider 86 fits in the slit 85 so as to be slidable horizontally along the slit 85. Not shown in FIG. 7, an identical slit 85 is formed in the side wall 74 opposite to the side wall 73 and an identical slider 86 extends from the other side end of the base member 83. Thus, above the first tray surface 72, the base member 83 is slidable horizontally along the slits 85 in the sheet-supply direction.

Figure 8:
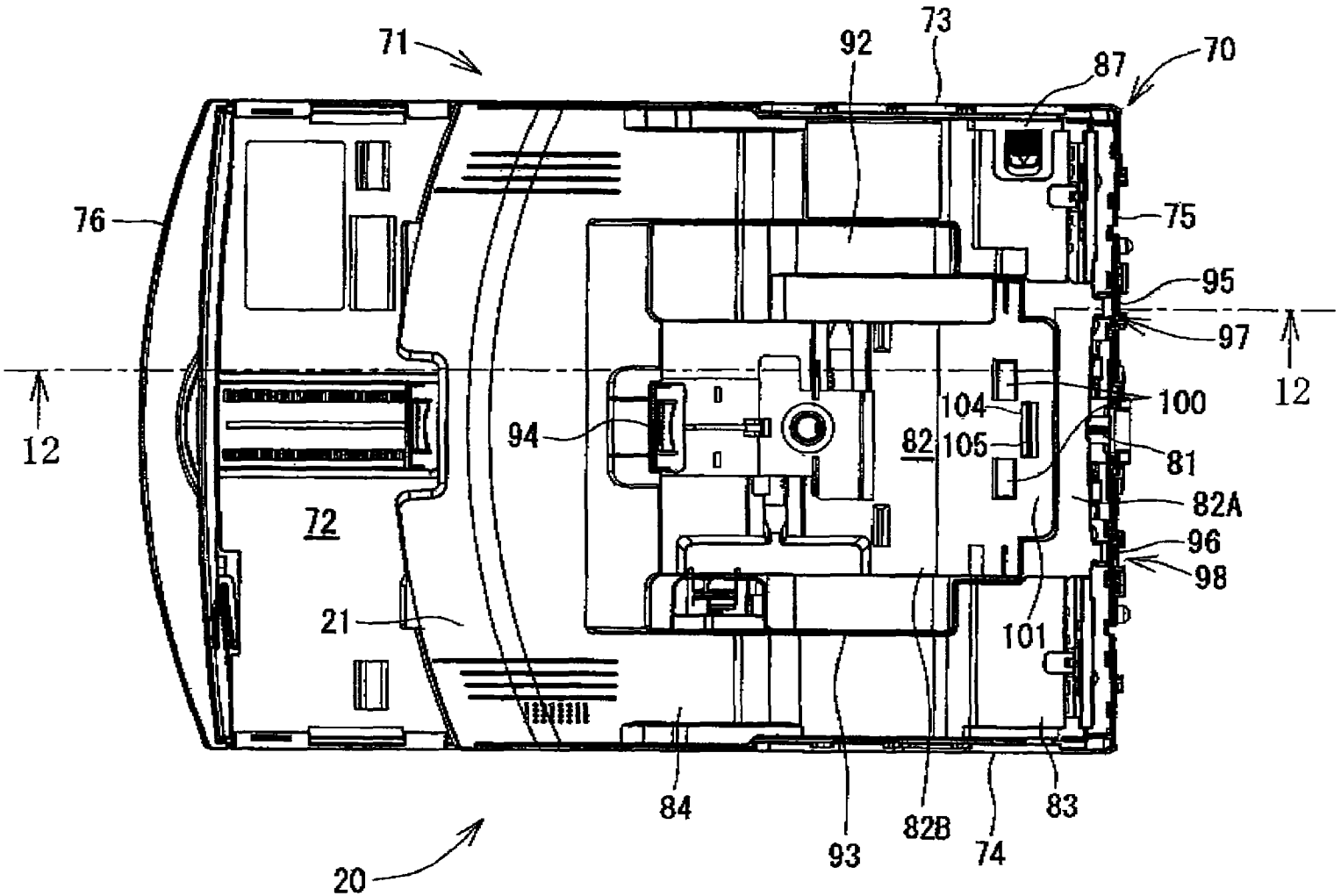
FIG. 8 is a plan view of the sheet-supply tray device whose second tray is in use.

As shown in FIGS. 5 through 7, a lock member 87 is provided in one side end portion of the base member 83. As indicated by an arrow 88, the lock member 87 is arranged to be slidable horizontally in the widthwise direction of the base member 83 (or in the direction perpendicular to the sheet-supply direction) relative to the base member 83. Also, the lock member 87 is biased by a spring to project in a direction indicated by the arrow 88. The lock member 87 has a lock claw, not shown. As shown in FIG. 7, two lock holes or recesses 89 (only one recess 89 is shown) are provided at respective predetermined positions of the slit 85 of the side wall 73. Each of the lock recesses 89 opens in the slit 85 in a vertically downward direction. The two lock recesses 89 are located at the respective positions in the sheet-supply direction so as to engage the lock claw of the lock member 87 and thereby inhibit the base member 83 from sliding. One of the two positions corresponds to the retracted position of the second tray 71, i.e., the in-use state of the first tray 70, as shown in FIGS. 5 and 6, and the other of the two positions corresponds to an advanced position of the second tray 71, i.e., an in-use state of the second tray 71 in which the base member 83 contacts the side wall 75 of the first tray 70, as shown in FIG. 8. FIG. 7 shows the in-use state of the first tray 70, so that the lock recess for placing the base member 83 in the in-use state of the second tray 71 is seen in FIG. 7. Since the lock claw of the lock member 87 engages either one of the lock recesses 89, the base member 83 is inhibited from sliding and positioned at the corresponding predetermined position of the slit 85. When the lock member 87 is slid in a direction opposite to the direction indicated by the arrow 88 against the biasing force of the spring, the lock claw is disengaged from the lock recess 89 so that the base member 83 is slidable along the slit 85 in the sheet-supply direction.

As shown in FIG. 6, the flap member 84, in its plan view, has a plate-like shape and has a width (a dimension measured in the direction perpendicular to the sheet-supply direction and parallel to the first tray surface 72) which is approximately equal to that of the first tray surface 72 of the first tray 70 and a length (a dimension measured in the sheet-supply direction) which is smaller than that of the fist tray surface 72. The length of the flap member 84 is equal to a distance between an upstream end of the base member 83 in the in-use state of the first tray 70 and the side wall 76 of the first tray 70. Thus, an upstream end of the flap member 84 is substantially aligned with the side wall 76 of the first tray 70. The flap member 84 is supported on the side walls 73, 74 such that the flap member 84 is slidable together with the base member 83 in the sheet-supply direction, on respective upper ends of the side walls 73, 74.

Figure 10:
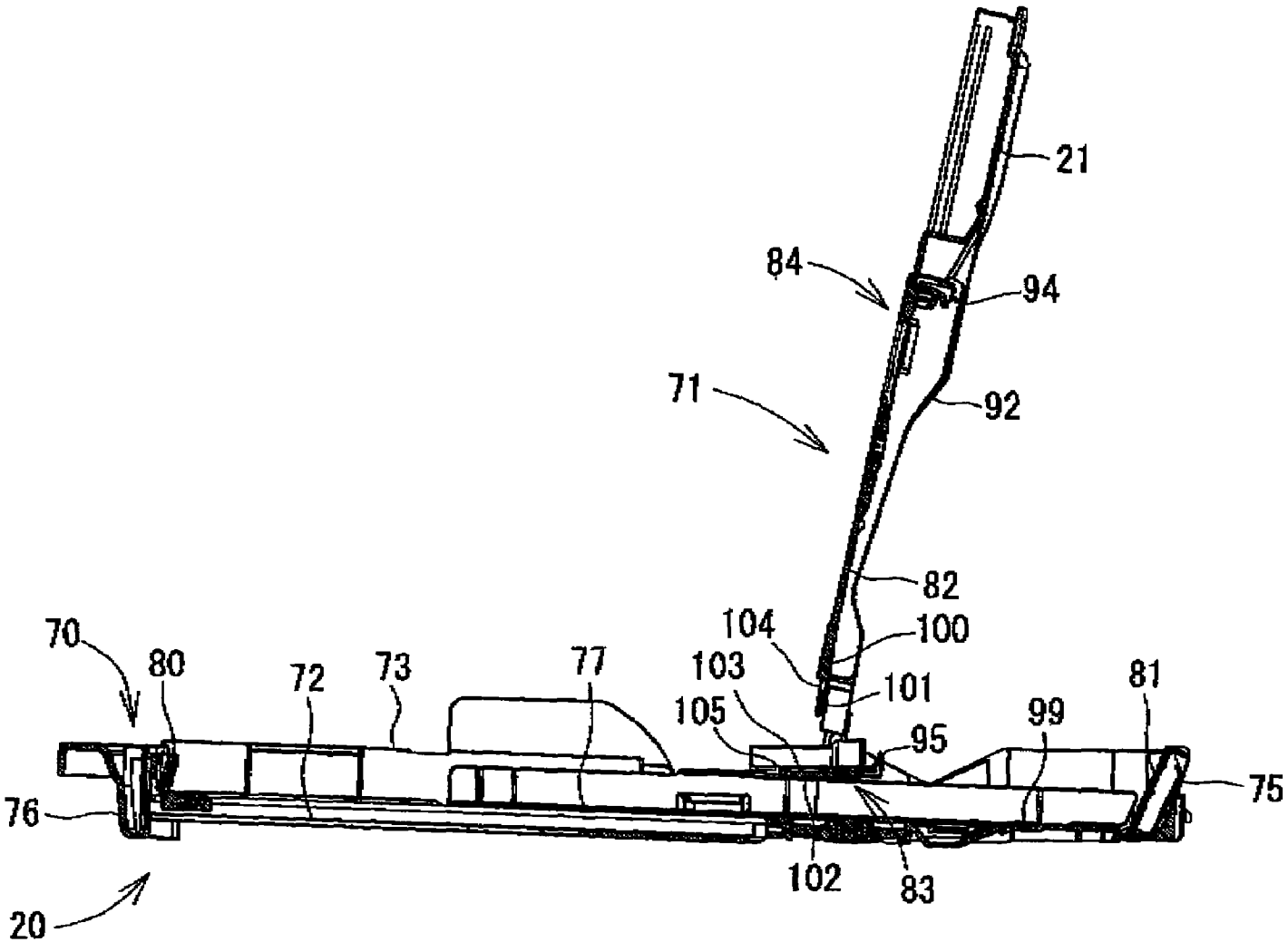
FIG. 10 is a cross-sectional view of the sheet-supply tray device whose second tray is in the opening state.

As shown in FIG. 9, the flap member 84 is supported by two shaft portions 90, 91 which are provided in an upstream end portion of the base member 83 in the sheet-supply direction and are distant from each other by an appropriate distance in the widthwise direction of the base member 83, such that the flap member 84 is freely pivotable about a pivot axis parallel to widthwise direction, relative to the base member 83. As shown in FIGS. 5 and 6, a state in which the flap member 84 is supported on the side walls 73, 74 to extend horizontally and cover a space above the first tray 70 is referred to as the stacked state. On the other hand, as shown in FIGS. 9 and 10, a state in which the flap member 84 is pivoted upward so as to open the space above the first tray 70 and thereby expose the first tray surface 72 is referred to as the opening state. The state of the flap member 84 is changeable between the stacked state and the opening state by a user's operation. When the sheet-supply tray device 20 is attached to the MFD 1, the flap member 84 is placed in the stacked state. The sheet-supply tray device 20 attached to the MFD 1 is maintained in the stacked state, and as described later, either one of the first tray 70 and the second tray 71 can supply the recording sheets according to the current position of the second tray 71 in the sheet-supply direction relative to the first tray 70, that is, the in-use state of the first tray 70 (in the state in which the second tray 71 is in the retracted position) or the in-use state of the second tray 71 (in the state in which the second tray 71 is in the advanced position). When new recording sheets are set in the first tray 70, the sheet-supply tray device 20 is detached from the MFD 1 and the flap member 84 is pivoted from the stacked state to the opening state. Thus, since the space above the first tray 70 is widely opened, the recording sheets are easily set in the first tray 70.

As shown in FIGS. 5 and 6, the second tray 71 includes a pair of side guide members 92, 93 distant from each other in a widthwise direction of the second tray surface 82. Since the recording sheets are placed between the two side guide members 92, 93, the opposite side edges of each of the recording sheets are positioned on the second tray surface 82. The side guide members 92, 93 are slidably movable according to the size of the recording sheets placed on the second tray surface 82 so that a distance therebetween is changed in the widthwise direction. In other words, the two side guide members 92, 93 are slidable toward a widthwise middle portion of the second tray surface 82 from the state shown in FIGS. 5 and 6 so as to shorten the distance therebetween. Not shown in detail in FIGS. 5 and 6, the side guide members 92, 93 are interlocked with each other by a rack and pinion device. That is, when either one of the two side guide members 92, 93 is moved in the widthwise direction, the pair of side guide members 92, 93 are slid symmetrically toward and away from each other with respect to a centerline (the reference line 79) of the second tray surface 82 in a direction perpendicular to the sheet-supply direction (in the widthwise direction). Accordingly, a centerline of each of the recording sheets positioned by the side guide members 92, 93 in the widthwise direction is aligned with the centerline (the reference line 79) of the second tray surface 82 in the widthwise direction. That is, the recording sheets are supplied from the second tray surface 82 while being positioned by the "center-registering".

The second tray 71 includes an upstream end guide 94 provided on the second tray surface 82. The upstream end guide 94 is movable corresponding to the size of the recording sheets placed on the second tray surface 82 such that a distance between the upstream end guide 94 and a downstream end of the base member 83 in the sheet-supply direction is changeable. The second tray 71 also includes a plurality of (two) downstream end guides 95, 96 on the downstream end of the base member 83 in the sheet-supply direction. The downstream end guides 95, 96 stand upright from the second tray surface 82, and more precisely, each of the downstream end guides 95, 96 has a generally L-shaped cross section, first protruding horizontally from the second tray surface 82 in the sheet-supply direction and then extending upward. The recording sheets are placed between the upstream end guide 94 and the downstream end guides 95, 96 and positioned in the sheet-supply direction in a state in which respective leading ends of each recording sheet contact the downstream end guides 95, 96. In FIG. 6, the downstream end guide 96 is not shown because the same 96 is located below the base shaft 26*a*.

As shown in FIGS. 5 and 6, the side wall 75 of the first tray 70 has two cut-away portions 97, 98 at respective positions corresponding to the two downstream end guides 95, 96 of the base member 83 in the widthwise direction perpendicular to the sheet-supply direction. As shown in FIG. 8, when the second tray 71 is slid to the advanced position and placed in the in-use state thereof, a downstream end of the base member 83 in the sheet-supply direction contacts the side wall 75 of the first tray 70. At the same time, the downstream end guides 95, 96 are inserted into the cut-away portions 97, 98 such that the respective upward extending portions of the downstream end guides 95, 96 project out of the side wall 75. Thus, the leading ends of the recording sheets which are positioned on the second tray surface 82 by the downward end guides 95, 96 contact the side wall 75. Then, the recording sheets placed on the second tray surface 82 are guided by the side wall 75 toward the guide surface of the outer guide member 18. The plurality of recording sheets placed on the second tray surface 82 are separated from each other such that the uppermost sheet projects toward the sheet-feed path 23 in the sheet-feed direction along the inclined surface of the side wall 75. Since the recording sheets engage the teeth of the sheet-separate member 81, only the uppermost sheet is surely separated from the other sheets. Further, the downstream end guides 95, 96 are inserted into the cut-away portions 97, 98 and the respective horizontally protruding portions of the guides 95, 96 are supported by the cut-away portions 97, 98. Therefore, in the in-use state of the second tray 71, a downstream portion of the base member 83 in the sheet-supply direction is supported by the side wall 75, When the second tray 71 is slid to the retracted position relative to the first tray 70 so as to place the sheet-supply tray device 20 in the in-use state of the first tray 70, as shown in FIGS. 5 and 6, the sheet-supply roller 25 contacts the first tray surface 72 of the first tray 70, as shown in FIGS. 3 and 6. As shown in FIG. 5, a frictional pad 99 is provided on the first tray surface 72, more precisely, a portion thereof with which the sheet-supply roller 25 is to come into contact. The frictional pad 99 has a common shape and is made of a material such as cork and rubber that has a frictional coefficient higher than that of the other portions of the first tray surface 72.

As shown in FIGS. 8, 12 and 13, when the second tray 71 is slid to the advanced position relative to the first tray 70 so as place the sheet-supply tray device 20 in the in-use state of the second tray 71, the sheet-supply roller 25 contacts the second tray surface 82. As shown in FIG. 8, a pair of frictional pads (frictional members) 100 are provided on the second tray surface 82, more precisely, a portion thereof with which the sheet-supply roller 25 is to come into contact. Each frictional pad 100 has a common shape and is made of a material such as cork and rubber that has a fictional coefficient higher than that of the other portions of the second tray surface 82. In the present embodiment, the pair of frictional pads 100 are distant from each other by an appropriate distance in an axial direction of the sheet-supply roller 25. A shape and a number of the frictional pad or pads 100 can be freely changed depending on the pressure applied by the sheet-supply roller 25 to the second tray surface 82.

A predetermined portion of the second tray surface 82 that includes the portion with which the sheet-supply roller 25 is to come into contact is extended horizontally from a downstream end of the flap member 84 in the sheet-supply direction (i.e., an end of the flap member 84 adjacent to the base member 83) so that the upstream second tray surface 82B is extended in the sheet-supply direction. A part of the flap member 84 constitutes a nip portion 101, and the part of the flap member 84 includes the thus extended portion and the portion with which the sheet-supply roller 25 is to come into contact. An upper surface of the nip portion 101 constitutes a part of the upstream second tray surface 82B such that a substantially middle portion of the upstream second tray surface 82B in the direction perpendicular to the sheet-supply direction is extended. The nip portion 101 is provided at the position where the sheet-supply roller 25 is pressed. In the present embodiment, the nip portion 101 is provided at a position corresponding to the reference line 79 with respect to which the recording sheets are positioned by the center-registering and around which the recording sheets are pressed by the sheet-supply roller 25.

As shown in FIGS. 12 and 13, in the state in which the flap member 84 is in the stacked state, the nip portion 101 is placed on the base member 83 and supported thereby from underside. As shown in FIG. 11, an upstream portion (a left-hand portion as seen in FIG. 11) of the base member 83 constitutes a thinned portion 102 corresponding to the nip portion 101. The thinned portion 102 is formed by decreasing a thickness of the base member 83. The thinned portion 102 has a support surface 103 lower than the downstream second tray surface 82A. The nip portion 101 is placed and supported on the support surface 103. An upper surface of the nip portion 101 constitutes a part of the upstream second tray surface 82B and in the state in which the flap member 84 is in the stacked state, the upstream second tray surface 82B is substantially flush with the downstream second tray surface 82A. In the present embodiment, the thinned portion 102 constitutes a support portion which supports the nip portion 101.

The nip portion 101 is placed or seated on the thinned portion 102 when the flap member 84 is pivoted from the opening state to the stacked state. A relative position between (a) a common axis of the shaft portions 90, 91 as the pivot axis of the flap member 84 and (b) the nip portion 101 and the thinned portion 102 is determined such that a downstream end of the nip portion 102 is prevented from being interfered with by the support surface 103 before a lower surface of the nip portion 101 comes in close contact with the support surface 103 as the upper surface of the thinned portion 102. That is, the relative position is determined such that the downstream end of the nip portion 101 and the support surface 103 as measured in a direction perpendicular to the support surface 103 decreases monotonously when the flap member 84 is pivoted from the opening state to the stacked state.

As shown in FIG. 11, a through-hole 104 is formed through a thickness of the nip portion 101, such that the through-hole 104 extends in the widthwise direction thereof perpendicularly to the sheet-supply direction. An engaging projection 105 is provided on the thinned portion 102 at a position corresponding to the through-hole 104, such that the engaging projection 105 projects upward from the support surface 103. As shown in FIG. 8, in the state in which the flap member 84 is in the stacked state, the nip portion 101 is placed on the support surface 103 and the engaging projection 105 is engages (or fits in) the through-hole 104. The engagement of the engaging projection 105 and the through-hole 104 prevents the nip portion 101 from moving on the support surface 103 in a horizontal direction, especially upstream with respect to the sheet-supply direction (i.e., leftward direction in FIG. 11).

In the present embodiment, the through-hole 104 constitutes a recessed portion and the engaging projection 105 constitutes a projection. The relative position among (a) the common axis of the shaft portions 90, 91, (b) the nip portion 101 and (c) the thinned portion 102 is determined such that the engaging projection 105 is allowed to fit in the through-hole 104. The engaging projection 105 has a cross-sectional shape which is taken along a plane perpendicular to the downstream second tray surface 82A and parallel to the sheet-supply direction and whose dimension as measured in the sheet-supply direction decreases in a direction from a bottom portion of the engaging projection 105 to a top portion thereof For example, the engaging projection 105 may have a trapezoidal shape in cross section. The engaging projection 105 may have a cross-sectional shape whose dimension in the sheet-supply direction decreases acceleratingly. Accordingly, the engaging projection 105 can be easily fitted in the through-hole 104 and also, after the engaging projection 105 is fitted in the through-hole 104, the engaging projection 105 can be reliably prevented from moving in the sheet-supply direction within the through-hole 104. In other words, in a state in which the engaging projection 105 is engaged with the through-hole 104, there is a clearance left between the top portion of the engaging projection 105 and the through-hole 104 but there is no clearance left between the bottom portion of the engaging projection 105 and the through-hole 104. However, the clearance between the bottom portion of the engaging projection 105 and the through-hole 104 may not be left in at least a downstream portion of the through-hole 104 in the sheet-supply direction. That is, the clearance between the bottom portion of the engaging projection 105 and the through-hole 104 may be left in an upstream portion of the through-hole 104 in the sheet-supply direction. The engaging projection 105 may have a rectangular shape in cross section and the through-hole 104 may have a trapezoidal shape in cross section. Each of the engaging projection 105 and the through-hole 104 may have a trapezoidal shape in cross section.

The bottom portion of the engaging projection 105 and the through-hole 104 may be formed such that no clearances are left therebetween in the sheet-supply direction and in the direction perpendicular to the sheet-supply direction. This arrangement assures that the base member 83 is securely united with the flap member 84 in the state in which the flap member 84 is in the stacked state. However, as described above, the clearance between the bottom portion of the engaging projection 105 and the through-hole 104 may be left in the upstream portion of the through-hole 104 in the sheet-supply direction. Clearances may be left on either side of the engaging projection 105 in the direction perpendicular to the sheet-supply direction. The more clearances are provided between the engaging projection 105 and the through-hole 104, the more easily the engaging projection 105 can be engaged with the through-hole 104, and the more easily the image recording apparatus can be manufactured. Also, the respective shapes of the through-hole 104 and the engaging projection 105 are not limited to those described in the present embodiment. For example, the shapes of the through-hole 104 and the engaging projection 105 may be circular in their cross-sectional views taken along a plane parallel to the support surface 103.

As described above, when the second tray 71 is slid relative to the first tray 70 so that the second tray 71 is placed in the in-use state thereof the sheet-supply roller 25 contacts the nip portion 101 of the second tray surface 82, as shown in FIGS. 12 and 13. As shown in FIG. 8, the frictional pads 100 are provided on the nip portion 101 and the recording sheets placed on the second tray surface 82 are nipped by and between the sheet-supply roller 5 and the frictional pads 100. In this state, the sheet-supply roller 25 is driven and rotated by the motor so that the recording sheets placed on the second tray surface 82 are supplied in the sheet-supply direction (i.e., a rightward direction in FIG. 12).

As shown in FIG. 12, in a state in which the sheet-supply roller 25 is close to the second tray surface 82, a lower end portion of the sheet-supply arm 26 that supports the sheet-supply roller 25 is somewhat pivoted downward from its horizontal posture. When the sheet-supply roller 25 is rotated to supply the recording sheets in the sheet-supply direction, the sheet-supply arm 26 receives a reaction force to pivot the arm 26 downward. Thus, the sheet-supply roller 25 is strongly pressed on the recording sheets and a frictional force produced between the sheet-supply roller 25 and the recording sheets is increased, so that each recording sheet pressed by the sheet-supply roller 25 is supplied in the sheet-supply direction with high reliability.

When the sheet-supply arm 26 is pivoted downward and the sheet-supply roller 25 is pressed on the recording sheets, the pressure from the sheet-supply roller 25 is applied to the nip portion 101 via the recording sheets. As described above, since the nip portion 101 is placed on the support surface 103 of the base member 83 and supported thereby from the underside, the nip portion 101 is prevented from being elastically flexed or being deformed because of the pressure from the sheet-supply roller 25. Also, in the in-use state of the second tray 71, the base member 83 is supported by the three side walls 73, 74, 75, so that the base member 83 can stand the pressure from the sheet-supply roller 25. Further, as described above, since the engagement of the through-hole 104 with the engaging projection 105 prevents the nip portion 101 from moving on the support surface 103 upstream with respect to the sheet-supply direction, especially prevents the flap member 84 and the base member 83 from moving away from each other in opposite directions parallel to the sheet-supply direction, respective middle portions of the flap member 84 and the base member 83 in the widthwise direction are effectively prevented from being flexed downward.

In the present MFD 1, the sheet-supply tray device 20 includes the first tray 70 and the second tray 71 and the recording sheets of different sizes and/or sorts can be accommodated in the first and the second trays 70, 71. Thus, two kinds of recording sheets which are frequently used can be accommodated simultaneously by the sheet-supply tray device 20. Thus, the user need not change the recording sheets accommodated by the sheet-supply tray device 20, depending on purposes of use.

The base member 83 and the flap member 84 of the second tray 71 are slidable between the advanced position and the retracted position in the sheet-supply direction relative to the first tray 70, and the sheet-supply roller 25 is contactable with the first tray surface 72 of the first tray 70 in the in-use state of the first tray 70 and is contactable with the second tray surface 82 of the second tray 71 in the in-use state of the second tray 71. That is, the sheet-supply roller 25 is selectively contactable with either one of the first tray surface 72 and the second tray surface 82. Accordingly, one sheet-supply roller 25 is commonly used for the first tray 70 and the second tray 71, leading to reducing the size and production cost of the MFD 1.

The flap member 84 is pivotable relative to the base member 83 and is changeable between the stacked state and the opening state by the user's operation. In the state in which the flap member 84 is in the opening state, new recording sheets are easily set in the first tray 70. In the state in which the flap member 84 is in the stacked state, a major part of the space above the first tray 70 is covered by the second tray 71, so that the recording sheets accommodated in the first tray 70 can be prevented from being damaged or discolored.

Since the nip portion 101 which the sheet-supply roller 25 advances toward and retracts from is provided in the flap member 84 of the second tray 71 and is supported by the support surface 103 of the base member 83, the nip portion 101 can stand the pressure from the sheet-supply roller 25. Also, owing to the engagement of the through-hole 104 with the engaging projection 105, the respective middle portions of the flap member 84 and the base member 83 are effectively restrained from being flexed downward. Thus, the nip portion 101 is effectively prevented from being moved downward or oscillated, and accordingly the recording sheets can be supplied with stability, In the present embodiment, the recording sheets supplied from the sheet-supply tray device 20 are conveyed through the sheet-feed path 23 as a U-turn path to the ink-jet image recording unit 24. A different sheet-feed path and/or a different type of image recording unit may be employed. For example, the image recording apparatus to which the present invention is applied may be embodied as a laser printer.

In the present embodiment, the nip portion 101 is supported directly by the base member 83 from the underside. Depending on a position where the nip portion 101 is provided, a portion of the flap member 84 that is adjacent to the nip portion 101 may be supported by the base member 83. In this arrangement, too, the flap member and a periphery of the base member are advantageously supported by the side walls of the first tray 70 and a middle portion of the flap member is advantageously supported by a middle portion of the base member from the underside.

Moreover, the engagement of the base member and the flap member is not limited to the engagement of the through-hole 104 and the engaging projection 105. The recessed portion such as the through-hole 104 may be provided in the base member and the projection such as the engaging projection 105 may be provided in the flap member.

It is to be understood that the present invention may be embodied with various changes, modifications, and improvements that may occur to a person skilled in the art without departing from the spirit and scope of the invention defined in the appended claims,

What is claimed is:

1. An image recording apparatus, comprising:

a sheet-supply tray device which accommodates a plurality of recording media;

a sheet-supply roller which supplies the recording media one by one in a sheet-supply direction; and an image recording device which records an image on each of the recording media, wherein the sheet-supply tray device includes a first tray which accommodates a plurality of first recording media on a first tray surface thereof such that the first recording media are stacked on each other and a second tray which is placed on the first tray and which accommodates a plurality of second recording media on a second tray surface thereof such that the second recording media are stacked on each other, the second tray including:

a base portion which is supported on the first tray and which constitutes a downstream tray surface that is a downstream side portion of the second tray surface in the sheet-supply direction; and a pivotable portion whose state is changeable between a stacked state in which the pivotable portion is supported on the first tray and an opening state in which the pivotable portion is pivoted relative to the base portion so as to open a space above the first tray and which constitutes an upstream tray surface that is an upstream side portion of the second tray surface in the sheet-supply direction, wherein the pivotable portion includes a nip portion which constitutes a part of the upstream tray surface, wherein the sheet-supply roller is configured to move toward and away from the nip portion, wherein in a state in which the pivotable portion is in the stacked state, at least one of (a) the nip portion and (b) a portion of the pivotable portion adjacent to the nip portion is supported by the base portion, wherein in the state in which the pivotable portion is in the stacked state, a substantially middle portion of the pivotable portion in a direction perpendicular to the sheet-supply direction engages a corresponding portion of the base portion such that at least the middle portion of the pivotable portion is prevented from moving away from the corresponding portion of the base portion in a direction parallel to the downstream tray surface, wherein the middle portion of the pivotable portion constitutes the nip portion and the corresponding portion of the base portion constitutes the support portion, wherein one of the nip portion and the support portion includes a recessed portion while an other of the nip portion and the support portion includes a projection, and wherein the recessed portion and the projection engage each other so that the nip portion is prevented from moving away from the support portion in the direction parallel to the downstream tray surface.

2. The image recording apparatus according to claim 1, wherein in the state in which the pivotable portion is in the stacked state, the nip portion is placed on a support surface of a support portion which constitutes a part of the base portion.

3. The image recording apparatus according to claim 2, wherein the nip portion is placed on the support surface of the support portion when the pivotable portion is pivoted from the opening state to the stacked state.

4. The image recording apparatus according to claim 1, wherein the projection has a cross-sectional shape which is taken along a plane perpendicular to the downstream tray surface and parallel to the sheet-supply direction and whose dimension as measured in the sheet-supply direction decreases in a direction from a bottom portion of the projection to a top portion thereof.

5. The image recording apparatus according to claim 1, wherein the recessed portion has a shape assuring that the recessed portion engages the projection such that a clearance is left therebetween in a direction parallel to the downstream tray surface and perpendicular to the sheet-supply direction.

6. The image recording apparatus according to claim 1, wherein an end portion of the pivotable portion which is adjacent to the base portion in the state in which the pivotable portion is in the stacked state comprises the nip portion.

7. The image recording apparatus according to claim 1, wherein the nip portion is provided by a substantially middle portion of the pivotable portion with respect to a direction parallel to the upstream tray surface and perpendicular to the sheet-supply direction.

8. The image recording apparatus according to claim 1, wherein the first tray includes a plurality of side walls standing upright from a periphery of the first tray surface on which the first recording media are stacked, and wherein the base portion of the second tray and the pivotable portion thereof in the stacked state are supported by the side walls.

9. The image recording apparatus according to claim 1, wherein the sheet-supply roller is selectively contactable with either one of the first tray surface of the first tray and the second tray surface of the second tray.

10. The image recording apparatus according to claim 9, wherein the base portion and the pivotable portion of the second tray are slidable between an advanced position and a retracted position in the sheet-supply direction relative to the first tray, and wherein the sheet-supply roller is contactable with the first tray surface of the first tray in a state in which the second tray is in the retracted position and the sheet-supply roller is contactable with the second tray surface of the second tray in a state in which the second tray is in the advanced position.

11. The image recording apparatus according to claim 1, wherein in the state in which the pivotable portion is in the stacked state, the nip portion is extended from a downstream end of the pivotable portion in the sheet-supply direction.

12. An image recording apparatus, comprising:

a sheet-supply tray device which accommodates a plurality of recording media;

a sheet-supply roller which supplies the recording media one by one in a sheet-supply direction; and an image recording device which records an image on each of the recording media, wherein the sheet-supply tray device includes a first tray which accommodates a plurality of first recording media on a first tray surface thereof such that the first recording media are stacked on each other and a second tray which is placed on the first tray and which accommodates a plurality of second recording media on a second tray surface thereof such that the second recording media are stacked on each other, the second tray including:

a base portion which is supported on the first tray and which constitutes a downstream tray surface that is a downstream side portion of the second tray surface in the sheet-supply direction; and a pivotable portion whose state is changeable between a stacked state in which the pivotable portion is supported on the first tray and an opening state in which the pivotable portion is pivoted relative to the base portion so as to open a space above the first tray and which constitutes an upstream tray surface that is an upstream side portion of the second tray surface in the sheet-supply direction, wherein the pivotable portion includes a nip portion which constitutes a part of the upstream tray surface, wherein the sheet-supply roller is moved toward and away from the nip portion, wherein in a state in which the pivotable portion is in the stacked state, at least one of (a) the nip portion and (b) a portion of the pivotable portion adjacent to the nip portion is supported by the base portion, wherein in the state in which the pivotable portion is in the stacked state, the nip portion is placed on a support surface of a support portion which constitutes a part of the base portion, wherein the support surface of the support portion facing upward is located at a lower position in a vertical direction than the downstream tray surface facing upward, and wherein an upper surface of the nip portion is substantially flush with the downstream tray surface in a state in which a lower surface of the nip portion is supported on the support surface.

13. The image recording apparatus according to claim 12, wherein a projection is provided on the support surface while a recessed portion engageable with the projection is provided in the lower surface of the nip portion, and wherein the projection engages the recessed portion in a state in which the lower surface of the nip portion is supported on the support surface so that the nip portion is prevented from moving away from the support portion in a direction parallel to the downstream tray surface.

* * * * *